US010818212B2

(12) United States Patent
Bai et al.

(10) Patent No.: US 10,818,212 B2
(45) Date of Patent: Oct. 27, 2020

(54) DISPLAY SUBSTRATE AND METHOD FOR DRIVING THE SAME, DISPLAY PANEL AND DISPLAY APPARATUS

(71) Applicants: Beijing BOE Optoelectronics Technology Co., Ltd., Beijing (CN); BOE Technology Group Co., Ltd., Beijing (CN)

(72) Inventors: Lu Bai, Beijing (CN); Yanna Xue, Beijing (CN); Zhiying Bao, Beijing (CN); Lei Mi, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/524,393

(22) Filed: Jul. 29, 2019

(65) Prior Publication Data

US 2020/0043394 A1 Feb. 6, 2020

(30) Foreign Application Priority Data

Aug. 1, 2018 (CN) ..... 2018 1 0864073

(51) Int. Cl.
*G09G 3/20* (2006.01)

(52) U.S. Cl.
CPC ..... *G09G 3/20* (2013.01); *G09G 2300/0426* (2013.01); *G09G 2300/0809* (2013.01); *G09G 2310/0272* (2013.01)

(58) Field of Classification Search
CPC ..... G09G 3/20; G09G 2300/0809; G09G 2300/0426; G09G 2310/0272; G09G 2320/0214; G09G 2310/0262; G09G 3/3648; G09G 2310/0205; G09G 3/3677; G09G 2310/08; G09G 3/2074; G09G 3/3607
See application file for complete search history.

(56) References Cited

U.S. PATENT DOCUMENTS

2005/0225523 A1* 10/2005 Park ..... G09G 3/3688 345/87
2006/0017714 A1* 1/2006 Yonemoto ..... H04N 5/3658 345/204
2006/0274008 A1* 12/2006 Lin ..... G09G 3/3659 345/92

(Continued)

*Primary Examiner* — Carolyn R Edwards
(74) *Attorney, Agent, or Firm* — Nath, Goldberg & Meyer; Joshua B. Goldberg

(57) ABSTRACT

The present application provides a display substrate and a method for driving the same, a display panel and a display apparatus. The display substrate includes pixel units, each of which includes a pixel electrode and a first transistor having a control electrode coupled to a gate line and a first electrode coupled to the pixel electrode. The display substrate further includes a second transistor coupled to a first pixel unit and a second pixel unit in a same column. The second transistor has a first electrode coupled to a second electrode of the first transistor of the first pixel unit and a second electrode of the first transistor of the second pixel unit, a control electrode coupled to a control line, and a second electrode coupled to a data line.

17 Claims, 6 Drawing Sheets

(56) References Cited

U.S. PATENT DOCUMENTS

| | | | | |
|---|---|---|---|---|
| 2009/0027325 | A1* | 1/2009 | Kim | G02F 1/134336 345/92 |
| 2009/0027581 | A1* | 1/2009 | You | G09G 3/3659 349/48 |
| 2012/0081343 | A1* | 4/2012 | Liu | G09G 3/3659 345/208 |
| 2014/0002509 | A1* | 1/2014 | Kim | G09G 3/3659 345/690 |
| 2015/0294616 | A1* | 10/2015 | Jang | G09G 3/3208 345/691 |

* cited by examiner

DISPLAY SUBSTRATE AND METHOD FOR DRIVING THE SAME, DISPLAY PANEL AND DISPLAY APPARATUS

CROSS-REFERENCE TO RELATED APPLICATION

This application claims priority to Chinese Patent Application No. 201810864073.3, filed on Aug. 1, 2018, the entire contents of which are hereby incorporated by reference.

TECHNICAL FIELD

The present disclosure relates to the field of display technology, and particularly, to a display substrate, a method for driving the same, a display panel and a display apparatus.

BACKGROUND

At present, electronic paper, total reflection and transflective display screens are widely used in electronic price tags, smart wearing equipment and outdoor portable devices. The main advantage of this type of display screens is that the display power consumption is reduced without affecting its display characteristics, and the display power consumption is about several tens of microwatts. The low power display is mainly implemented by the low-frequency driving method. In the low-frequency driving method, the display time of one frame of image is long, and is usually 1 second (s) or more.

SUMMARY

In an aspect, the present disclosure provides a display substrate, including a plurality of pixel units arranged in an array having rows and columns, and each of the plurality of pixel units including a pixel electrode and a first transistor having a control electrode coupled to a gate line and a first electrode coupled to the pixel electrode, wherein the display substrate further includes at least one second transistor, each of the at least one second transistor is coupled to two pixel units in a same column of the plurality of pixel units, the two pixel units includes a first pixel unit and a second pixel unit, the second transistor has a first electrode coupled to a second electrode of the first transistor of the first pixel unit and a second electrode of the first transistor of the second pixel unit, a control electrode coupled to a control line, and a second electrode coupled to a data line.

In some embodiments, the first pixel unit and the second pixel unit are two adjacent pixel units of the plurality of pixel units.

In some embodiments, the first transistor of the first pixel unit is in a region of the first pixel unit close to the second pixel unit, the first transistor of the second pixel unit is in a region of the second pixel unit close to the first pixel unit, and the second transistor is between the pixel electrode of the first pixel unit and the pixel electrode of the second pixel unit.

In some embodiments, the at least one second transistor includes a plurality of second transistors, each of the plurality of second transistors is coupled to two pixel units in a same column of the plurality of pixel units, and the pixel units of the plurality of pixel units coupled to different second transistors are different.

In some embodiments, the plurality of pixel units includes 2M*N pixel units constituting a pixel array having 2M rows and N columns; the plurality of second transistors includes M*N second transistors constituting a transistor array having M rows and N columns; and two pixel units coupled to the second transistor in a m-th row and an n-th column of the transistor array are a pixel unit in a (2m−1)-th row and an n-th column of the pixel array and a pixel unit in a 2m-th row and the n-th column of the pixel array, respectively, where $1 \le m \le M$, $1 \le n \le N$, and m and n are integers.

In some embodiments, in the transistor array, control electrodes of second transistors in a same row are coupled to a same control line; and control electrodes of second transistors in different rows are coupled to different control lines.

In some embodiments, in the pixel array, a gate line coupled to a 2i-th row of pixel units and a gate line coupled to a (2i+1)-th row of pixel units are electrically coupled, where $1 \le i \le M-1$, and i is an integer.

In some embodiments, the display substrate further includes a gate driver, wherein the gate driver includes a first output terminal coupled to the gate line and configured to output a gate driving signal and a second output terminal coupled to the control line and configured to output a gate driving signal as a control signal.

In some embodiments, the display substrate further includes 2M gate lines and M control lines, wherein the 2M gate lines are coupled to the 2M rows of pixel units in the pixel array in one-to-one correspondence; and the M control lines are coupled to the M rows of second transistors in the transistor array in one-to-one correspondence.

In some embodiments, the display substrate further includes a gate driver having 2M+1 output terminals, wherein in the 2M+1 output terminals: a first output terminal is coupled to a first gate line of the 2M gate lines, a second output terminal is coupled to a first control line of the M control lines, a (2j−1)-th output terminal is coupled to a (2j−2)-th gate line and a (2j−1)-th gate line of the 2M gate lines, a 2j-th output terminal is coupled to a j-th control line of the M control lines, and a (2j+1)-th output terminal is coupled to a 2j-th gate line of the 2M gate lines, where $1 \le j \le M$ and j is an integer.

In some embodiments, the 2M+1 output terminals are configured to output gate driving signals to the 2M gate lines and configured to output gate driving signals as control signals to the M control lines.

In another aspect, the present disclosure further provides a display panel, including any one of the display substrates described herein.

In another aspect, the present disclosure further provides a display apparatus, including any one of the display panels described herein.

In another aspect, the present disclosure further provides a method for driving a display substrate, the display substrate including a plurality of pixel units arranged in an array having rows and columns, and each of the plurality of pixel units including a pixel electrode and a first transistor having a control electrode coupled to a gate line and a first electrode coupled to the pixel electrode, the display substrate further including at least one second transistor, each of the at least one second transistor being coupled to two pixel units including a first pixel unit and a second pixel unit in a same column of the plurality of pixel units, the second transistor having a first electrode coupled to a second electrode of the first transistor of the first pixel unit and a second electrode of the first transistor of the second pixel unit, a control electrode coupled to a control line, and a second electrode coupled to a data line, wherein the method includes: during a driving period of the first pixel unit, controlling the second transistor to be turned on through the control line, the first transistor of the first pixel unit to be turned on through a gate line coupled to the first pixel unit, and the first transistor of the second pixel unit to be turned off through a gate line coupled to the second pixel unit; during a driving period of the second pixel unit, controlling the second transistor to be turned on through the control line, the first transistor of the first pixel unit to be turned off through the gate line coupled to the first pixel unit, and the first transistor of the second pixel unit to be turned on through the gate line coupled to the second pixel unit; and during other period, controlling the second transistor to be turned off through the control line.

In some embodiments, during the driving period of the first pixel unit, the second transistor is controlled to be turned on by a control signal input through the control line, and the first transistor of the first pixel unit is controlled to be turned on by a first signal input through the gate line coupled to the first pixel unit; and during the driving period of the second pixel unit, the second transistor is controlled to be turned on by the control signal input through the control line, and the first transistor of the second pixel unit is controlled to be turned on by a second signal input through the gate line coupled to the second pixel unit; wherein a duration of the first signal overlaps with a duration of the control signal, a duration of the second signal overlaps with the duration of the control signal; and the duration of the first signal does not overlap with the duration of the second signal in time.

In some embodiments, each of the durations of the first signal, the second signal and the control signal is 2H, the duration of the first signal and the duration of the control signal have an overlapping duration of H, and the duration of the second signal and the duration of the control signal have an overlapping duration of H.

In some embodiments, the first signal, the second signal and the control signal are gate driving signals output from a gate driver of the display substrate.

DETAILED DESCRIPTION

Figure 1:
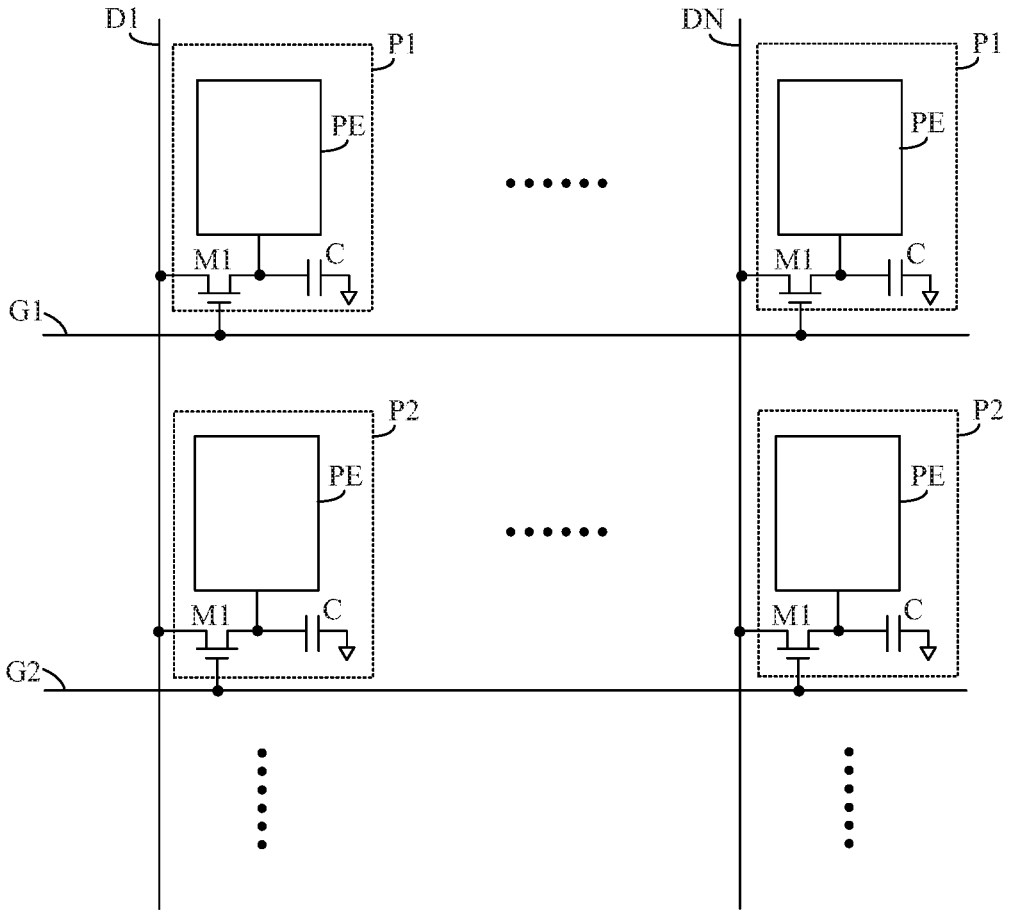
FIG. 1 is a schematic diagram of a display substrate with a single TFT pixel design in the related art.

In order to enable those skilled in the art to better understand the technical solutions of the present disclosure, the display substrate, the method for driving the same, the display panel and the display apparatus provided by the present disclosure will be described in detail below with reference to the accompanying drawings.

It should be noted that, the transistors can be divided into an N-type transistor and a P-type transistor according to their characteristics. For an N-type transistor, the effective level voltage (the voltage that causes the transistor to be turned on) corresponding thereto is a high level voltage, and the non-effective level voltage (the voltage that causes the transistor to be turned off) corresponding thereto is a low level voltage. For a P-type transistor, the effective level voltage corresponding thereto is a low level voltage, and the non-effective level voltage corresponding thereto is a high level voltage. In the following description, a case in which each transistor is an N-type transistor is exemplified. However, those skilled in the art should know that the transistor in the present disclosure may also be a P-type transistor, and the type of the transistor is not limited in the present disclosure.

In the present disclosure, a control electrode of a transistor refers to the gate electrode of the transistor, and the first and second electrodes of the transistor refer to the source and drain electrodes of the transistor, respectively, and the first electrode and the second electrode are interchangeable.

At present, electronic paper, total reflection and transflective display screens are widely used in electronic price tags, smart wearing equipment and outdoor portable devices. The main advantage of this type of display screens is that the display power consumption is reduced without affecting its display characteristics, and the display power consumption is about several tens of microwatts. The low power display is mainly implemented by the low-frequency driving method. In the low-frequency driving method, the display time of one frame of image is long, and is usually 1 second (s) or more, leading to higher requirements on pixel voltage holding capability of the low power consumption display products.

In the related art, in order to solve the above problem, on the one hand, a dual thin film transistor (TFT) design is adopted to minimize the leakage current of the TFT. On the other hand, a size of a holding capacitor (also referred to as a storage capacitor) of a pixel is increased to increase the pixel voltage holding capability.

However, it has been found in practical applications that for color display products having high PPI (Pixels Per Inch) and low power consumption, pixel size is small and the dual TFT unit occupies a certain space of the pixel, resulting in that the holding capacitor of the pixel is small. Therefore, the ability to hold the voltage is not high during the refresh time of one frame of image in the low-frequency driving method, which cannot satisfy the requirements of the color display products having high PPI and low power consumption.

FIG. 1 is a schematic diagram of a display substrate with a single TFT pixel design in the related art. As shown in FIG. 1, the display substrate includes a plurality of rows of pixel units (P1, P2, . . . ), a plurality of gate lines (G1, G2, . . . ), and a plurality of data lines D1 to DN. A respective one of the plurality of rows of pixel units is coupled to a respective one of the plurality of gate lines. Each of the plurality of pixel units is provided therein with a pixel electrode PE, a switching transistor M and a holding capacitor C. The control electrode of the switching transistor M is coupled to a corresponding one of the gate lines.

Next, a process of driving the plurality of rows of pixel units of the display substrate with the single TFT pixel design will be briefly described.

During driving of the first row of pixel units P1, a gate driving signal in an effective level state is written to each of the switching transistors M1 of the first row of pixel units P1 through the gate line G1 to control each of the switching transistors M1 of the pixel units P1 to be turned on. At the same time, data signals in the data lines D1 to DN are respectively written into the respective pixel electrodes PE of the first row of pixel units P1 through the respective switching transistors M1 of the first row of pixel units P1, and each of the holding capacitors C of the first row of pixel units P1 is charged.

After the driving of the first row of pixel units P1 is completed, a gate driving signal in a non-effective level state is written to each of the switching transistors M1 of the first row of pixel units P1 through the gate line G1 to control the first row of pixel units P1 to be turned off. At the same time, a gate driving signal in an effective level state is written to each of the switching transistors M1 of the second row of pixel units P2 through the gate line G2 to drive the second row of pixel units P2.

In the subsequent process, the remaining rows of pixel units are sequentially driven. However, in the subsequent process of driving each row of pixel units and performing stable display, a leakage current flows out at the switching transistor M1 although the switching transistor M1 in the pixel unit P1 is in an off state, so that the voltage at one terminal of the holding capacitor C coupled to the switching transistor M1 is reduced and the pixel voltage loaded onto the pixel electrode PE is also reduced, thereby causing display distortion of the pixel unit P1.

In the related art, a display substrate with a dual TFT pixel design is also proposed on the basis of the display substrate shown in FIG. 1. In the display substrate with the dual TFT pixel design, each row of pixel units corresponds to two gate lines, and each of the pixel units is provided therein with two switching transistors connected in series, and the control electrodes of the two switching transistors are coupled to corresponding two gate lines, respectively.

Figure 2:
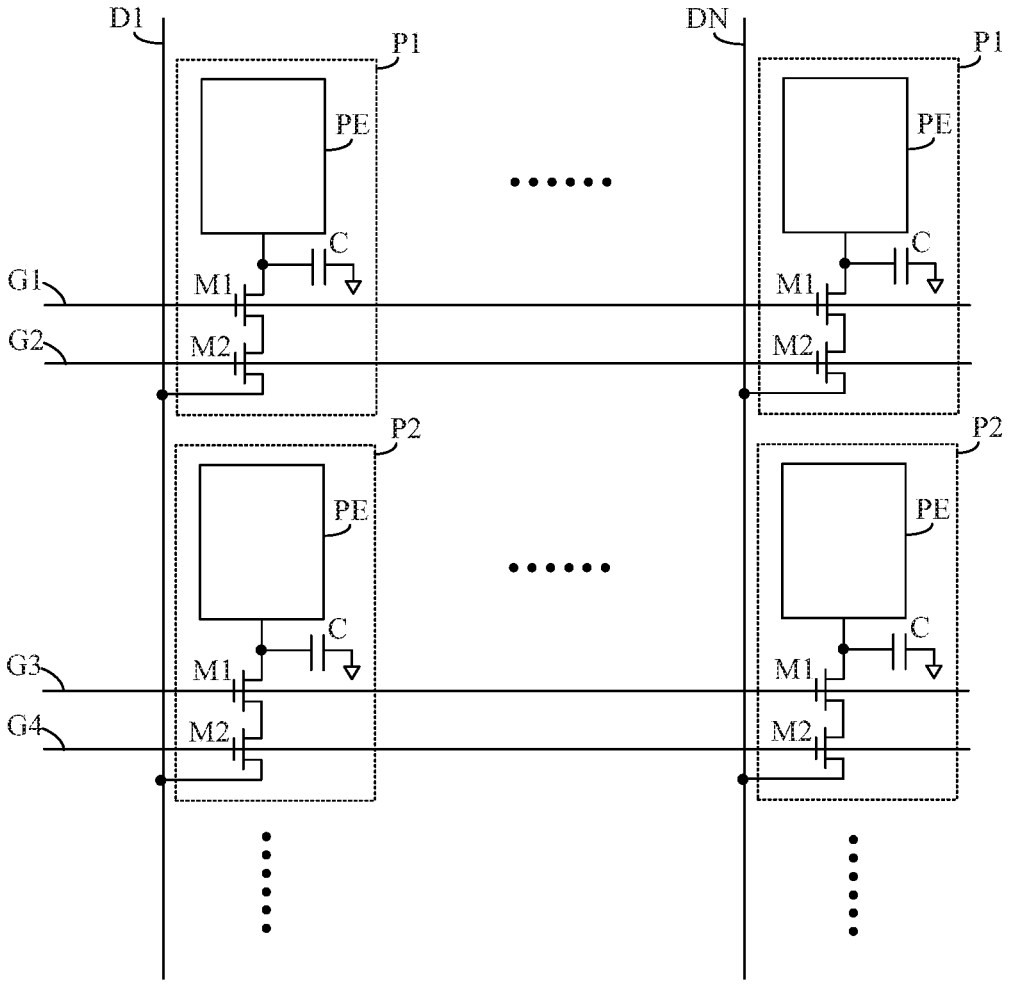
FIG. 2 is a schematic diagram of a display substrate with a dual TFT pixel design in the related art.

FIG. 2 is a schematic diagram of a display substrate with a dual TFT pixel design in the related art. As shown in FIG. 2, the first row of pixel units P1 corresponds to two gate lines G1 and G2, each of the pixel units P1 is provided therein with two switching transistors M and M2 connected in series, and the control electrodes of the two switching transistors M1 and M2 are coupled to the two gate lines G1 and G2, respectively (i.e., the control electrode of the transistor M1 is coupled to the gate line G1, and the control electrode of the transistor M2 is coupled to the gate line G2). The second row of pixel units P2 and other rows of pixel units also have substantially the same configuration as the first row of pixel units.

Next, a process of driving the plurality of rows of pixel units of the display substrate with the dual TFT pixel design will be briefly described.

During driving of the first row of pixel units P1, the respective switching transistors M1 and the respective switching transistors M2 of the first row of pixel units P1 are controlled to be turned on through the gate line G1 and the gate line G2, respectively. At the same time, the data signals in the data lines D1 to DN are written into the respective pixel electrodes PE through the respective switching transistors M1 and M2 in the first row of pixel units P1, and the respective holding capacitors C are charged.

After the driving of the first row of pixel units P1 is completed, the respective switching transistors M1 and the respective switching transistors M2 of the first row of pixel units P1 are controlled to be turned off through the gate line G1 and the gate line G2, respectively. Since the switching transistor M2 is turned off, the corresponding switching transistor M1 connected thereto is disconnected from the corresponding data line. At this time, one terminal of the switching transistor M1 coupled to the switching transistor M2 is in a floating state, and thus there is no leakage current at the switching transistor M1. The dual TFT pixel design can effectively prevent the capacitor C and the pixel electrode PE from being discharged through the switching transistor M1.

In the subsequent process, the remaining rows of the pixel units are sequentially driven in a manner similar to the above-described driving process.

However, it has been found in practical applications that each pixel unit in the display substrate shown in FIG. 2 includes two switching transistors, and in a case where the size of the display area in the pixel unit is constant, the area in the pixel unit that can be used to set the holding capacitor C is small. Since the voltage holding capability (charge storage capability) of the holding capacitor C is positively correlated with the size of the capacitor (the size of the electrode plate constituting the capacitor), the voltage holding capability of the holding capacitor in the display substrate is relatively weak, and it is difficult to satisfy the requirements of the color display products having high PPI and low power consumption.

Accordingly, the present disclosure provides, inter alia, a display substrate, a method for driving the same, a display panel and a display apparatus that substantially obviate one or more of the problems due to limitations and disadvantages of the related art.

In one aspect, the present disclosure provides a display substrate. In some embodiments, the display substrate includes a plurality of pixel units arranged in an array having rows and columns, and each of the plurality of pixel units includes a pixel electrode and a first transistor having a control electrode coupled to a gate line and a first electrode coupled to the pixel electrode. The display substrate further includes at least one second transistor, and each second transistor is coupled to two pixel units including a first pixel unit and a second pixel unit in a same column of the plurality of pixel units. The second transistor has a first electrode coupled to a second electrode of the first transistor of the first pixel unit and a second electrode of the first transistor of the second pixel unit, a control electrode coupled to a control line, and a second electrode coupled to a data line.

Figure 3:
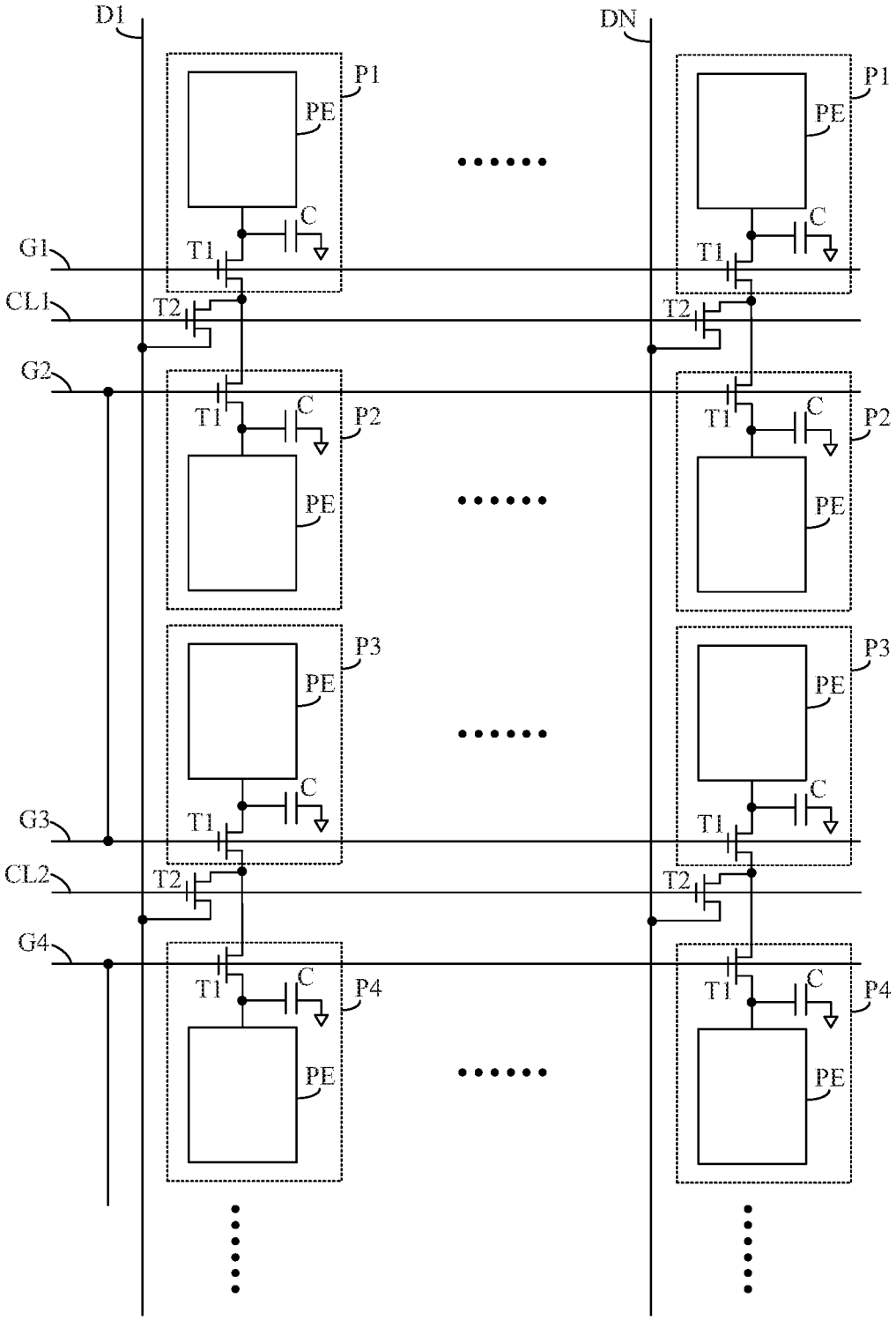
FIG. 3 is a schematic diagram of a display substrate according to some embodiments of the present disclosure.

FIG. 3 is a schematic diagram of a display substrate according to some embodiments of the present disclosure. As shown in FIG. 3, the array substrate in some embodiments includes a plurality of rows of pixel units (P1, P2, P3, P4, . . . ) arranged in an array having rows and columns, a plurality of gate lines (G1, G2, G3, G4, . . . ), a plurality of data lines D1 to DN and a plurality of control lines (GL1, GL2, . . . ). A respective one of the plurality of pixel units includes a pixel electrode PE and a first transistor T1 having a control electrode coupled to a respective one of the plurality of gate lines and a first electrode coupled to the pixel electrode PE. In some embodiments, the display substrate further includes: a second transistor T2, which is coupled to the respective one of the plurality of pixel units and another one of the plurality of pixel units in a same column with the respective one of the plurality of pixel units. The second transistor T2 has a control electrode coupled to a respective one of the plurality of control lines, a first electrode coupled to the second electrodes of the first transistors of the respective one and the other one of the plurality of pixel units and a second electrode coupled to a respective one of the plurality of data lines.

In the present disclosure, by having the second transistor T2, the leakage current problem does not occur at the first transistors T1 in an off state in the two pixel units coupled to the second transistor T2. In addition, the second transistor T2 is coupled to two pixel units, that is, two first transistors T1 of the two pixel units share one second transistor T2. In this case, for the two pixel units, each of the two pixel units corresponds to 1.5 switching transistors. Therefore, compared with the configuration in the related art in which each pixel unit corresponds to two switching transistors, the technical solution of the present disclosure can solve the leakage current problem of the TFT while reducing the number of TFTs on the display substrate, which allows a larger area in the pixel unit for setting the holding capacitor C, and in turn can increase the voltage holding capability of the holding capacitor C.

In some embodiments, the number of the second transistor T2 is plural, and every two of the plurality of pixel units (which are located in a same column) are coupled to a respective one of the plurality of second transistors T2. In other embodiments, at least one (but not all) of the plurality of pixel units is not coupled to any second transistor T2, and the second electrode of the first transistor T1 of the at least one of the plurality of pixel units is directly coupled to a corresponding one of the data lines (for example, the case as shown in FIG. 1), or the second electrode of the first transistor T1 in the at least one of the plurality of pixel unit is coupled to a corresponding one of the data lines through an additional switching transistor (for example, the case as shown in FIG. 2).

Figure 4:
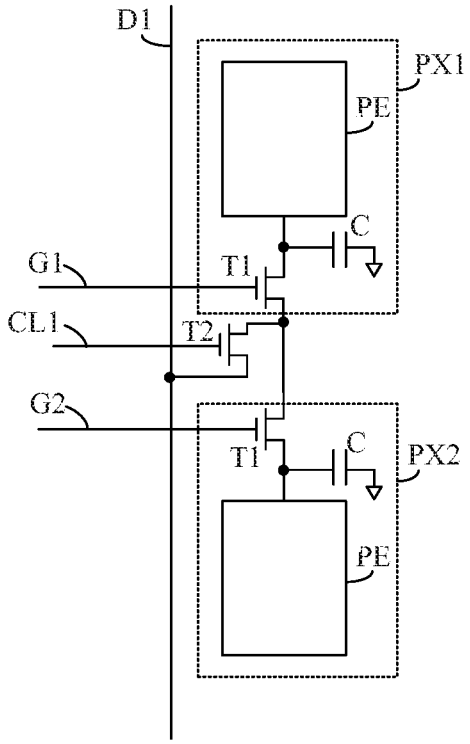
FIG. 4 is a schematic diagram of an example in which one second transistor is coupled to two pixel units, according to some embodiments of the present disclosure.

FIG. 4 is a schematic diagram of an example in which one second transistor is coupled to two pixel units, according to some embodiments of the present disclosure. The two pixel units PX1 and PX2 in FIG. 4 may correspond to the pixel units P1 and P2 in the first column of pixel units in FIG. 3. As shown in FIG. 4, in some embodiments, the two pixel units coupled to the second transistor T2 are the two pixel units PX1 and PX2 in a same column and adjacent to each other (i.e., no other pixel units exist therebetween). In this case, the sum of the distances between the second transistor T2 and the first transistors T1 of the two pixel units PX1 and PX2 coupled thereto can be effectively shortened. Accordingly, the length of the signal trace for connecting the first electrode of the second transistor T2 and the second electrodes of the first transistors T1 of the two pixel units PX1 and PX2 coupled thereto can be shortened correspondingly, and the area occupied by the signal trace is reduced, so that the area where the holding capacitor C can be set can be further increased.

The two pixel units PX1 and PX2 to which the second transistor T2 is coupled may be referred to as a first pixel unit PX1 and a second pixel unit PX2, respectively. In some embodiments, the first transistor T1 of the first pixel unit PX1 is located in a region of the first pixel unit PX1 close to the second pixel unit PX2, the first transistor T1 of the second pixel unit PX2 is located in a region of the second pixel unit PX2 close to the first pixel unit PX1, and the second transistor T2 is located between the pixel electrode PE of the first pixel unit PX1 and the pixel electrode PE of the second pixel unit PX2. In this case, the sum of the distances between the second transistor T2 and the first transistors T1 of the two pixel units PX1 and PX2 is minimized. Accordingly, the length of the signal trace for connecting the first electrode of the second transistor T2 and the second electrodes of the first transistors T1 of the two pixel units PX1 and PX2 coupled thereto is minimized.

In some embodiments, the number of the plurality of pixel units is 2M*N, and M*N second transistors T2 may be disposed, that is, a corresponding one of the second transistors T2 is disposed for each pixel unit (as shown in FIG. 3). In this case, since each of the pixel units is provided with a corresponding one of the second transistors T2, the leakage current problem does not occur to the first transistor T1 of each of the pixel units.

In some embodiments, the 2M*N pixel units constitute a pixel array having 2M rows and N columns; the M*N second transistors T2 constitute a transistor array having M rows and N columns; and two pixel units coupled to the second transistor T2 in a m-th row and an n-th column of the transistor array are the pixel unit located in a (2m−1)-th row and an n-th column of the pixel array and the pixel unit located in a 2m-th row and the n-th column of the pixel array, respectively, where $1 \le m \le M$, $1 \le n \le N$, and m and n are integers.

In some embodiments, control electrodes of the second transistor T2 in a same row are coupled to a same control line; and control electrodes of the second transistor T2 in different rows are coupled to different control lines. Therefore, the number of control lines for controlling the second transistors T2 can be reduced. For example, for the transistor array having M rows and N columns constituted by the M*N second transistors T2, only M control lines need to be provided.

In some embodiments, in the pixel array, a gate line coupled to a 2i-th row of pixel units and a gate line coupled to a (2i+1)-th row of pixel units are electrically coupled; where $1 \le i \le M-1$, and i is an integer. As such, the number of driving signal output terminals of a gate driver (e.g., the gate driver as shown in FIG. 5) for providing gate driving signals to the gate lines in the display substrate can be reduced.

In some embodiments, the gate driver may be a gate driving circuit formed on an array substrate (Gate Driver On Array (GOA)). In other embodiments, the gate driver may be a gate driver chip (IC) that is disposed through a packaging process.

Figure 5:
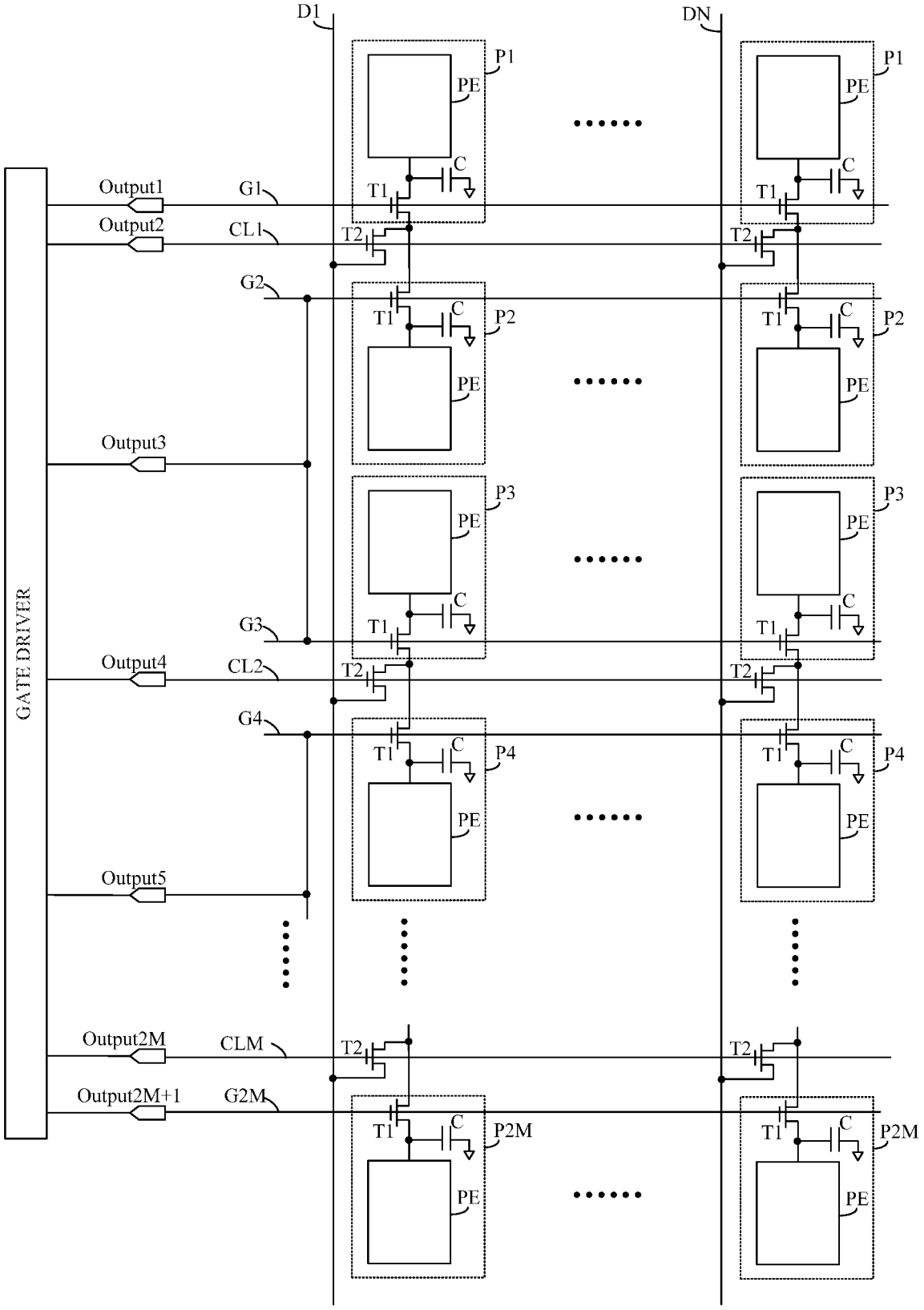
FIG. 5 is a schematic diagram showing connection of driving signal output terminals of a gate driver with gate lines and control lines, according to some embodiments of the present disclosure.

FIG. 5 is a schematic diagram showing connection of driving signal output terminals of a gate driver with gate lines and control lines, according to some embodiments of the present disclosure. In the present disclosure, as shown in FIG. 5, the gate driving signals output by the gate driver can not only drive the gate lines, but also drive the control lines, that is, the gate driving signals output by the gate driver can be used as a control signal for driving the control line. In some embodiments, the gate driver may include a first output terminal coupled to the gate line and configured to output a gate driving signal, and a second output terminal coupled to the control line and configured to output a gate driving signal as a control signal.

As shown in FIG. 5, for 2M gate lines G1 to G2M and M control lines CL1 to CLM, the gate driver is provided with 2M+1 driving signal output terminals Output1 to Output2M+1.

In the 2M+1 driving signal output terminals Output1 to Output2M+1, the first driving signal output terminal Output1 is coupled to the first gate line G1, the second driving signal output terminal Output2 is coupled to the first control line CL, the (2j−1)-th driving signal output terminal Output2*j*−1 is coupled to the (2j−2)-th gate line G2*j*−2 and the (2j−1)-th gate line G2*j*−1, the 2j-th driving signal output terminal Output2*j* is coupled to the j-th control line CLj, and the (2j+1)-th driving signal output terminal Output2*j*+1 is coupled to the 2j-th gate line G2*j*, where $1 \le j \le M$ and j is an integer.

Figure 6:
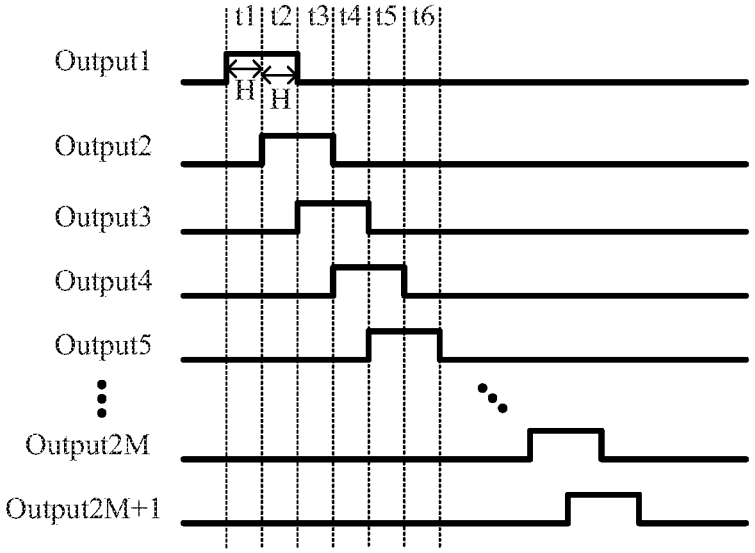
FIG. 6 is an operational timing diagram of a display substrate according to some embodiments of the present disclosure.

FIG. 6 is an operational timing diagram of a display substrate according to some embodiments of the present disclosure. As shown in FIG. 5 and FIG. 6, the driving signal output terminals of the gate driver sequentially output gate driving signals in an effective level state at an interval of a duration H, and each gate driving signal is in an effective level state for a duration of 2H.

At time t1, the first transistors T1 of the first row of pixel units P1 are turned on, and the second transistors T2 coupled to the first row of pixel units P1 are turned off, so the pixel electrodes PE of the first row of pixel units P1 are disconnected from the data lines D1 to DN, respectively.

At time t2, the first transistors T1 of the first row of pixel units P1 are kept turned on, and the second transistors T2 coupled to the first row of pixel units P1 are turned on, so the pixel electrodes PE of the first row of pixel units P1 are electrically coupled to the data lines D1 to DN, respectively, thereby driving the first row of pixel units P1.

At time t3, the first transistors T1 of the first row of pixel units P1 are turned off, the first transistors T1 of the second row of pixel units P2 are turned on, and the second transistors T2 coupled to the second row of pixel units P2 are kept turned on. Therefore, the pixel electrodes PE of the second row of pixel units P2 are electrically coupled to the data lines D1 to DN, respectively, thereby driving the second row of pixel units P2.

At time t4, the second transistors T2 coupled to the first row of pixel units P1 and the second row of pixel units P2 are turned off, and current leakage at the first transistors T1 of the first and second rows of pixel units P1 and P2 can be avoided at time t4 and in subsequent process. At the same time, the first transistors T1 of the third row of pixel units P3 are turned on, and the second transistors T2 coupled to the third row of pixel units P3 are turned on, so the pixel electrodes PE of the third row of pixel units P3 are electrically coupled to the data lines D1 to DN, respectively, thereby driving the third row of pixel units P3.

At time t5, the first transistors T1 of the third row of pixel units P3 are turned off, the first transistors T1 of the fourth row of pixel units P4 are turned on, and the second transistors T2 coupled to the fourth row of pixel units P4 are turned on, so the pixel electrodes PE of the fourth row of pixel units P4 are electrically coupled to the data lines D1 to DN, respectively, thereby driving the fourth row of pixel units P4.

At time t6, the second transistors T2 coupled to the third row of pixel units P3 and the fourth row of pixel units P4 are turned off, and current leakage at the first transistors T1 of the third and fourth rows of pixel units P3 and P4 can be avoided at time t6 and in subsequent process. At the same time, the first transistors T1 of the fifth row of pixel units (not shown) are turned on, and the second transistors T2 coupled to the fifth row of pixel units are turned on, so the pixel electrodes PE of the fifth row of pixel units are electrically coupled to the data lines D1 to DN, respectively, thereby driving the fifth row of pixel units.

After the process similar to the above driving method, the remaining rows of pixel units are sequentially driven, and each row of the second transistors T2 is turned off after driving of corresponding two rows of pixel units is completed, thereby preventing the current leakage from occurring to the first transistors T1 of the corresponding two rows of pixel units.

In the display substrate shown in FIG. 3, each pixel unit averagely corresponds to 1.5 switching transistors. Therefore, compared with the configuration in the related art in which each pixel unit corresponds to two switching transistors, the technical solution of the present disclosure can solve the leakage current problem of the TFT while reducing the number of TFTs on the display substrate, which allows a larger area in the pixel unit for setting the holding capacitor C, and in turn can increase the voltage holding capability of the holding capacitor C.

In another aspect, the present disclosure further provides a display panel including any of the display substrates described herein.

In another aspect, the present disclosure further provides a display apparatus including the display panel described herein.

The display apparatus in the present disclosure may be a component or product having a display function such as a liquid crystal display, a notebook computer, a navigator, a tablet computer, a mobile phone or the like.

Figure 7:
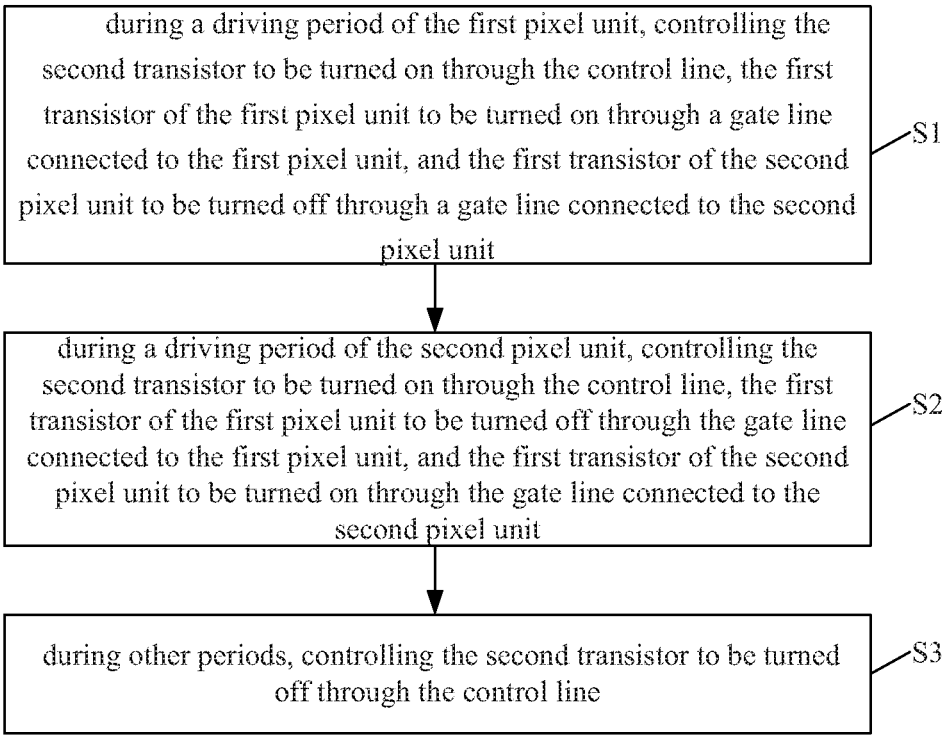
FIG. 7 is a flow chart of a method for driving a display substrate according to some embodiments of the present disclosure.

In another aspect, the present disclosure further provides a method for driving a display substrate. FIG. 7 is a flow chart of a method for driving a display substrate according to some embodiments of the present disclosure. In some embodiments, the display substrate is a display substrate as described herein. The method for driving the display substrate will be described with reference to FIGS. 4 and 7. As shown in FIGS. 4 and 7, the two pixel units coupled to the second transistor T2 are a first pixel unit PX1 and a second pixel unit PX2, respectively, and the driving process for the first pixel unit PX1 and the second pixel unit PX2 includes steps S1 to S3.

In step S1, during a driving period of the first pixel unit PX1, the second transistor T2 is controlled to be turned on through the control line CL1, the first transistor T1 of the first pixel unit PX1 is controlled to be turned on through the gate line G1 coupled to the first pixel unit PX1, and the first transistor T1 of the second pixel unit PX2 is controlled to be turned off through the gate line G2 coupled to the second pixel unit PX2. In this case, the data signal is written from the data line D1 to the pixel electrode PE of the first pixel unit PX1 through the second transistor T2 and the first transistor T1 of the first pixel unit PX1, and the holding capacitor C of the first pixel unit PX1 is charged.

In step S2, during a driving period of the second pixel unit PX2, the second transistor T2 is controlled to be turned on through the control line GL, the first transistor T1 of the first pixel unit PX1 is controlled to be turned off through the gate line G1 coupled to the first pixel unit PX1, and the first transistor T1 of the second pixel unit PX2 is controlled to be turned on through the gate line G2 coupled to the second pixel unit PX2. In this case, the data signal is written from the data line D1 to the pixel electrode PE of the second pixel unit PX2 through the second transistor T2 and the first transistor T1 of the second pixel unit PX2, and the holding capacitor C of the second pixel unit PX2 is charged.

The first pixel unit and the second pixel unit can be driven through the above steps S1 and S2.

In step S3, the second transistor T2 is controlled to be turned off through the control line GL1 in other periods.

In step S3, when the second transistor T2 is turned off, occurrence of current leakage at the first transistors T1 of the first pixel unit PX1 and the second pixel unit PX2 can be prevented.

It should be noted that the execution order of the steps S1 to S3 is not limited in the technical solution of the present disclosure. The specific descriptions of the foregoing steps S1 to S3 may refer to the contents in the foregoing embodiments, and will not be repeated here.

Further, it can be understood that although the method for driving the display substrate is described only with respect to the first pixel unit PX1 and the second pixel unit PX2 in FIG. 4, the driving method can be extended to at least a part or all of the pixel units of the display substrate.

It is to be understood that the above embodiments are merely exemplary embodiments employed to explain the principles of the present disclosure, but the present disclosure is not limited thereto. Various modifications and improvements can be made by those skilled in the art without departing from the spirit and scope of the disclosure, and such modifications and improvements are also considered to be within the scope of the disclosure.

What is claimed is:

1. A display substrate, comprising a plurality of pixel units arranged in an array having rows and columns, and each of the plurality of pixel units comprising a pixel electrode and a first transistor having a control electrode coupled to a gate line and a first electrode coupled to the pixel electrode, wherein the display substrate further comprises at least one second transistor, each of the at least one second transistor is coupled to two pixel units in a same column of the plurality of pixel units, the two pixel units comprises a first pixel unit and a second pixel unit, the second transistor has a first electrode directly coupled to a second electrode of the first transistor of the first pixel unit and a second electrode of the first transistor of the second pixel unit, a control electrode directly coupled to a control line, and a second electrode directly coupled to a data line.

2. The display substrate of claim 1, wherein the first pixel unit and the second pixel unit are two adjacent pixel units of the plurality of pixel units.

3. The display substrate of claim 2, wherein the first transistor of the first pixel unit is in a region of the first pixel unit close to the second pixel unit;

the first transistor of the second pixel unit is in a region of the second pixel unit close to the first pixel unit; and the second transistor is between the pixel electrode of the first pixel unit and the pixel electrode of the second pixel unit.

4. The display substrate of claim 1, wherein the at least one second transistor comprises a plurality of second transistors, each of the plurality of second transistors is coupled to two pixel units in a same column of the plurality of pixel units, and pixel units of the plurality of pixel units coupled to different second transistors are different.

5. The display substrate of claim 4, wherein the plurality of pixel units comprises 2M*N pixel units constituting a pixel array having 2M rows and N columns;

the plurality of second transistors comprises M*N second transistors constituting a transistor array having M rows and N columns; and two pixel units coupled to the second transistor in a m-th row and an n-th column of the transistor array are a pixel unit in a (2m−1)-th row and an n-th column of the pixel array and a pixel unit in a 2m-th row and the n-th column of the pixel array, respectively, where $1 \le m \le M$, $1 \le n \le N$, and m and n are integers.

6. The display substrate of claim 5, wherein in the transistor array, control electrodes of second transistors in a same row are coupled to a same control line; and control electrodes of second transistors in different rows are coupled to different control lines.

7. The display substrate of claim 5, wherein in the pixel array, a gate line coupled to a 2i-th row of pixel units and a gate line coupled to a (2i+1)-th row of pixel units are electrically coupled, where $1 \le i \le M-1$, and i is an integer.

8. The display substrate of claim 1, further comprising a gate driver, wherein the gate driver comprises a first output terminal coupled to the gate line and configured to output a gate driving signal and a second output terminal coupled to the control line and configured to output a gate driving signal as a control signal.

9. The display substrate of claim 5, further comprising 2M gate lines and M control lines, wherein the 2M gate lines are coupled to 2M rows of pixel units in the pixel array in one-to-one correspondence; and the M control lines are coupled to M rows of second transistors in the transistor array in one-to-one correspondence.

10. The display substrate of claim 9, further comprising a gate driver having 2M+1 output terminals, wherein in the 2M+1 output terminals:

a first output terminal is coupled to a first gate line of the 2M gate lines, a second output terminal is coupled to a first control line of the M control lines, a (2j−1)-th output terminal is coupled to a (2j−2)-th gate line and a (2j−1)-th gate line of the 2M gate lines, a 2j-th output terminal is coupled to a j-th control line of the M control lines, and a (2j+1)-th output terminal is coupled to a 2j-th gate line of the 2M gate lines, where $1 < j \le M$ and j is an integer.

11. The display substrate of claim 10, wherein the 2M+1 output terminals are configured to output gate driving signals to the 2M gate lines and configured to output gate driving signals as control signals to the M control lines.

12. A display panel, comprising the display substrate of claim 1.

13. A display apparatus, comprising the display panel of claim 12.

14. A method for driving a display substrate, the display substrate comprising a plurality of pixel units arranged in an array having rows and columns, and each of the plurality of pixel units comprising a pixel electrode and a first transistor having a control electrode coupled to a gate line and a first electrode coupled to the pixel electrode, the display substrate further comprising at least one second transistor, each of the at least one second transistor being coupled to two pixel units comprising a first pixel unit and a second pixel unit in a same column of the plurality of pixel units, the second transistor having a first electrode coupled to a second electrode of the first transistor of the first pixel unit and a second electrode of the first transistor of the second pixel unit, a control electrode coupled to a control line, and a second electrode coupled to a data line, wherein the method comprises:

during a driving period of the first pixel unit, controlling the second transistor to be turned on through the control line, the first transistor of the first pixel unit to be turned on through a gate line coupled to the first pixel unit, and the first transistor of the second pixel unit to be turned off through a gate line coupled to the second pixel unit;

during a driving period of the second pixel unit, controlling the second transistor to be turned on through the control line, the first transistor of the first pixel unit to be turned off through the gate line coupled to the first pixel unit, and the first transistor of the second pixel unit to be turned on through the gate line coupled to the second pixel unit; and during other periods, controlling the second transistor to be turned off through the control line.

15. The method of claim 14, wherein during the driving period of the first pixel unit, the second transistor is controlled to be turned on by a control signal input through the control line, and the first transistor of the first pixel unit is controlled to be turned on by a first signal input through the gate line coupled to the first pixel unit; and during the driving period of the second pixel unit, the second transistor is controlled to be turned on by the control signal input through the control line, and the first transistor of the second pixel unit is controlled to be turned on by a second signal input through the gate line coupled to the second pixel unit;

wherein a duration of the first signal overlaps with a duration of the control signal, a duration of the second signal overlaps with the duration of the control signal; and the duration of the first signal does not overlap with the duration of the second signal.

16. The method of claim 15, wherein each of the durations of the first signal, the second signal and the control signal is 2H, the duration of the first signal and the duration of the control signal have an overlapping duration of H, and the duration of the second signal and the duration of the control signal have an overlapping duration of H.

17. The method of claim 15, wherein the first signal, the second signal and the control signal are gate driving signals output from a gate driver of the display substrate.

* * * * *